United States Patent [19]

Steinfeld et al.

[11] Patent Number: 4,634,049

[45] Date of Patent: Jan. 6, 1987

[54] CONCRETE CROSSTIE WITH RECESSES AND METHOD FOR THE PRODUCTION THEREOF

[75] Inventors: Horst E. Steinfeld, Schwerte; Gerd Westerdorff, Dusseldorf, both of Fed. Rep. of Germany

[73] Assignee: Hoesch Aktiengesellschaft, Fed. Rep. of Germany

[21] Appl. No.: 710,025

[22] Filed: Mar. 11, 1985

[30] Foreign Application Priority Data

Mar. 9, 1984 [DE] Fed. Rep. of Germany ..... 3408597

[51] Int. Cl.[4] ..... E01B 9/30

[52] U.S. Cl. ..... 238/84; 238/338; 238/349; 249/61; 249/83; 249/91; 249/205

[58] Field of Search ..... 238/310, 338, 349, 351, 238/374, 84; 249/61, 62, 83, 91, 96, 205

[56] References Cited

U.S. PATENT DOCUMENTS

| | | | |
|---|---|---|---|
| 1,042,071 | 10/1912 | Bates | 238/374 X |
| 1,752,152 | 3/1930 | Dalton | 238/351 |
| 3,129,887 | 4/1964 | Meier | 238/265 |
| 4,339,077 | 7/1982 | Dahlhaus et al. | 238/349 |

FOREIGN PATENT DOCUMENTS

| | | | |
|---|---|---|---|
| 1363386 | 5/1964 | France | 238/351 |
| 1805 | 1/1977 | Japan | 238/374 |
| 884237 | 12/1961 | United Kingdom | 238/349 |
| 1010878 | 11/1965 | United Kingdom | 238/349 |
| 2045320 | 10/1980 | United Kingdom | 238/349 |

*Primary Examiner*—Randolph A. Reese

*Attorney, Agent, or Firm*—McCormick, Paulding & Huber

[57] ABSTRACT

A concrete crosstie has a recess for holding a rail securing member engaging beneath a nose in the recess. Upper ends holding the rail down resiliently are loop-shaped, to obtain a low surface pressure at two spaced areas and exact positioning of the rail securing member in the recess. The greatest possible crosstie cross-section is retained in that the recess only partially penetrates the concrete crosstie. The nose lower and side faces and the rail foot support surface are formed by steel reinforcements connected to the concrete.

5 Claims, 3 Drawing Figures

CONCRETE CROSSTIE WITH RECESSES AND METHOD FOR THE PRODUCTION THEREOF

Figure 1:
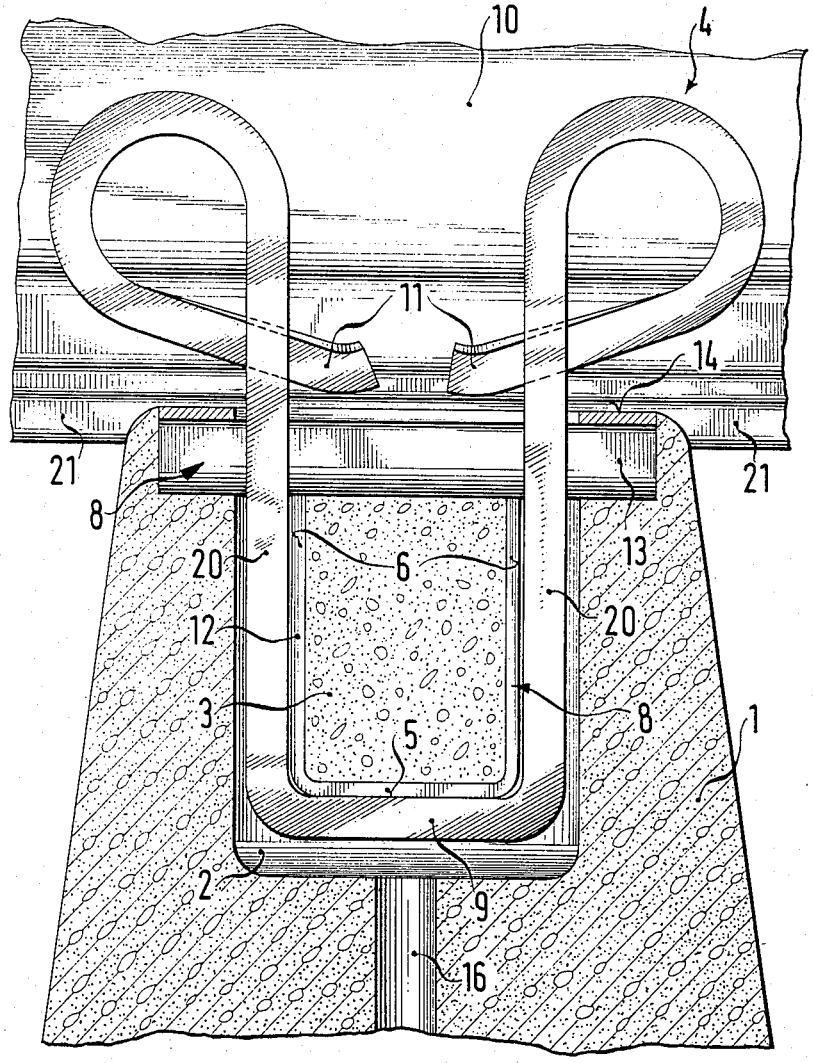

The invention relates to a concrete crosstie with recesses each for holding a rail securing member engaging beneath a nose in the recess, the ends holding the rail down resiliently being made loop-shaped, and a method for the production thereof.

Concrete crossties are used in lying railway tracks on ballast. They are made in various forms in order with the various types of rail securing members to be able to transmit the forces to be conducted from the rail into the ground and impart adequate stability to the track grid.

It is known from DE-patent No. 2,944,725 to provide concrete crossties at the securing points with recesses which have noses beneath which the rail securing members engage which in turn hold the rails on the crosstie. The arrangement is such that a rail securing member engages with two shanks into two recesses. As a result only small areas are available which have to apply the holding forces through a high surface pressure.

It is further known from GB-patent No. 1,010,878 to improve the transfer of the surface pressure by reinforcing the noses at the lower side with steel bodies. A disadvantage of this embodiment is that the rail securing members introduce a high force locally into the concrete and even in the reinforced state this can lead to breakages in the concrete. Another disadvantage is that only inaccurate production tolerances can be kept.

Accordingly the problem underlying the invention is to further develop a crosstie of the type mentioned at the beginning in such a manner that it is able via a suitable rail securing member to obtain a small surface pressure in the concrete and with high production accuracy permit exact positioning of the rail securing member. The objective is to insure that the greatest possible crosstie cross-section remains so that the crosstie has adequate dimensions to be able to transmit the necessary forces.

This problem is solved according to the invention in that the recess only partially penetrates the concrete crosstie and the nose lower and side faces and the rail foot support surface are formed by steel reinforcements connected to the concrete.

Further advantages embodiments are set forth hereinafter.

The method of making the recesses in the concrete crossties is characterized in that the recesses are formed by corresponding filling bodies which are inserted into the casting mold and which receive the steel reinforcements in form-locking manner in corresponding recesses and after the setting of the concrete crosstie the filling bodies are dissolved out chemically or by heat.

The advantageous achieved with the invention reside in particular in that no cracks occur in the concrete due to vibration under traffic between the rail securing member and the crosstie because the support surface between rail securing member and concrete is protected by a steel reinforcement and due to the continuous form of the rail securing member the minimum possible surface pressure is obtained in the holding region. This constructional form further has the great advantage that exact tolerances can be kept between crosstie, rail and rail securing member because the steel reinforcements can be made exactly and inserted at the crosstie surface. Another advantage is that the recesses can be made with minimum tolerances because they are very accurately predefined by filling bodies in the casting mold for the concrete and furthermore by the form-locking connection of filling body and steel reinforcements a further increase in the shape accuracy is obtained.

Figure 2:
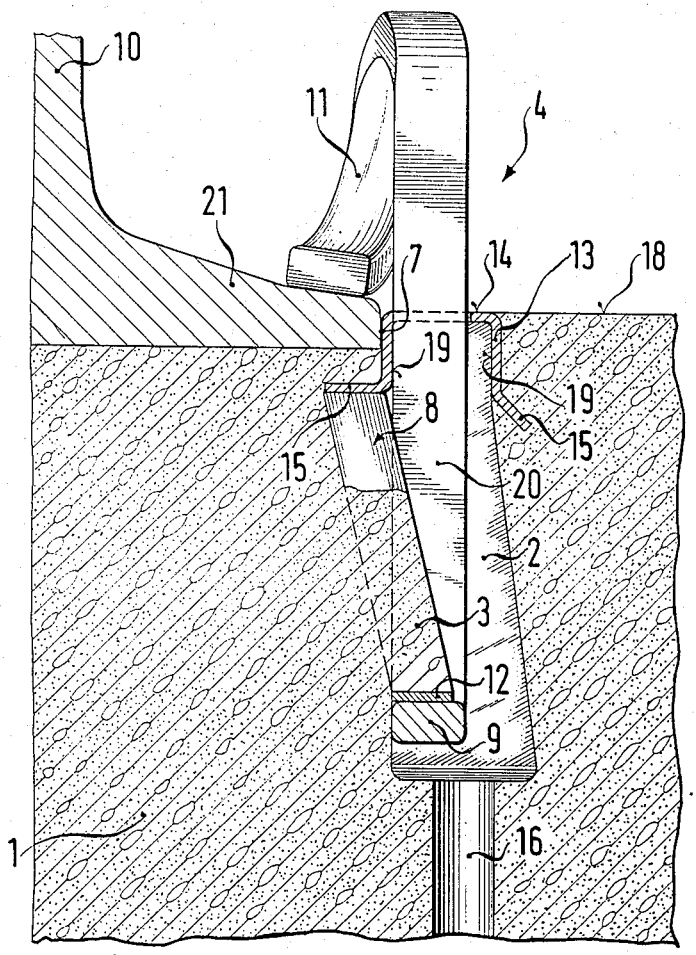

An example of embodiment of the invention is illustrated in the drawings and will be described in detail hereinafter. In the drawings FIG. 1 is a cross-section through a crosstie in the region of a recess in the rail longitudinal direction, FIG. 2 is a vertical longitudinal section through the center of the crosstie according to FIG. 1, FIG. 3 shows a filling body for making the recess.

The concrete crosstie 1 is made in a casting mold which is not illustrated. It is an open mold in which the concrete crosstie 1 is molded with the head side 18 downwards. The concrete crosstie 1 comprises a recess 2 having a nose 3. The recess 2 and nose 3 are surrounded by a steel reinforcement 8. The steel reinforcement 8 consists of a shaped strip 12 and a surface metal plate 13 which are joined together for example by welding. The surface metal plate 13 is angled twice. Its upper edge 14 frames the upper opening of the recess 2 and is flush with the head side 18 of the concrete crosstie 1. Side faces 19 of the surface metal plate 13 are drawn downwardly into the concrete and form side faces in the upper region of the recess 2. The side face facing the rail 10 forms the rail foot support surface 7. The lower edge 15 of the surface metal plate 13 is angled again and thus penetrates directly into the concrete. This angled portion can have undulated outer contours to permit better digging into the concrete. The shaped strip 12 is connected in this region to the surface metal plate 13. It forms the side faces 6 and the lower face 5 of the nose 3 and with constant width it is more or less embedded in the concrete. The rail securing member 4 connecting the rail 10 and the concrete crosstie is U-shaped. The connecting web 9 engages beneath the nose 3 and merges angled into holding flanges 20 which are bent at right-angles and enclose the nose 3 laterally. Said holding flanges 20 are made loop-shaped at their ends 11 and resiliently hold the rail 10 down at the rail foot 21. The rail securing member 4 is introduced in known manner inclined into the recess 2 so that it slides into the recess adjacent the nose 3. After tensioning the rail securing member 4 via its loops it can be folded with its connecting web 9 under the lower face 5 of the nose 3 and then secures rail 10 and concrete crosstie 1 resiliently together under a defined pretension.

Figure 3:
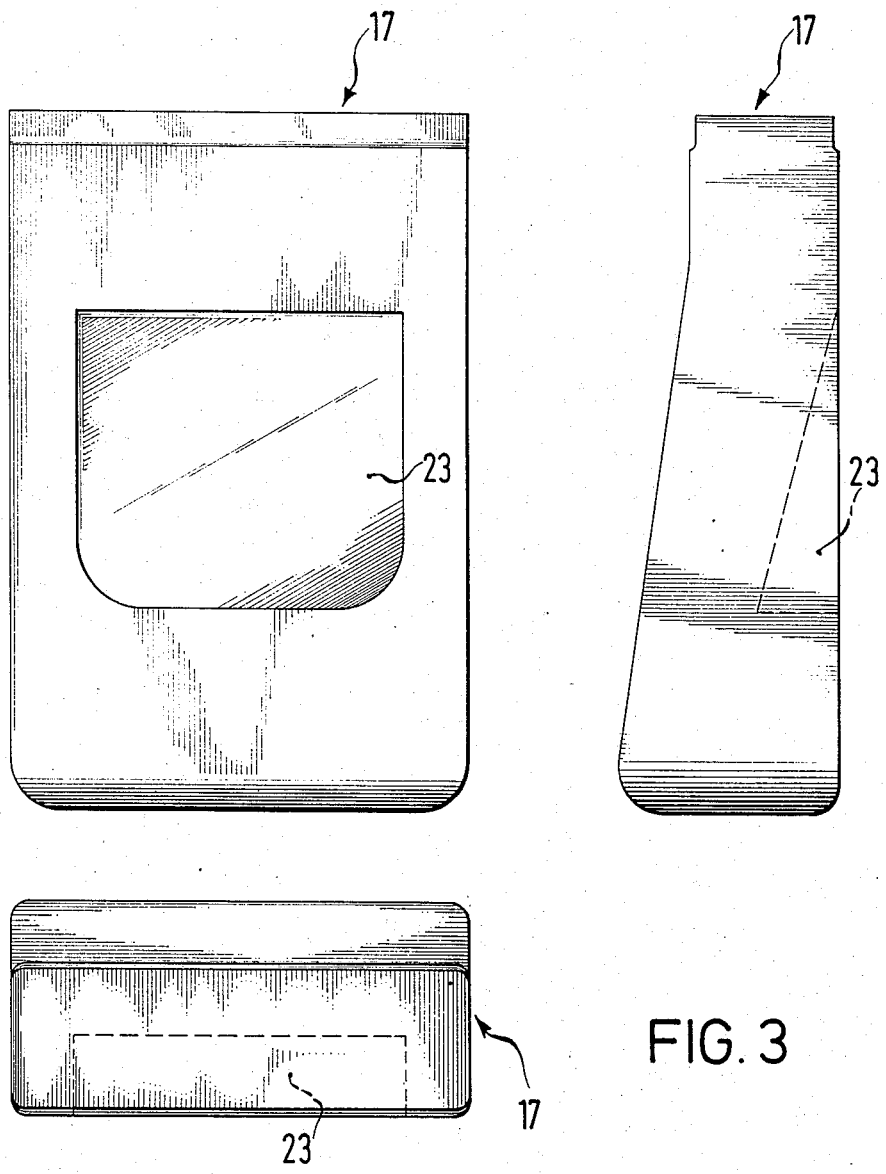

To make the recess 2 a corresponding filling body 17 is provided as indicated in FIG. 3. This filling body 17 preferably consists of foamed polystyrene. It comprises a recess 23 into which the steel reinforcement 8 is inserted in form-locking manner. The steel reinforcements 8 connected together and filling body 17 are positioned into the casting mold and locked with pins. These subsequently removable pins form in the finished concrete crosstie 1 the drain bore 16 through which water which penetrates the recess 2 can flow away downwardly.

Advantageously, after the setting of the concrete crosstie 1 the filling body 17 is dissolved out chemically or by heat. It cannot easily be removed mechanically because the recess 2 according to the invention is undercut.

We claim:

1. A concrete crosstie and rail securing member combination; the concrete crosstie having a recess with a generally rectangular nose formed therein having a generally horizontal downwardly facing bearing surface at the bottom and two side surfaces which are generally vertical and which are spaced apart horizontally, and the rail securing member being generally U-shaped with a loop at the free end portion of each arm of the U and with the free end of the arm extending generally horizontally and flexible generally vertically through the spring action inherent in its associated loop, the body of the U-shaped rail securing member being disposed beneath and retained against upward movement by the downwardly facing bearing surface of the nose in the recess of the crosspiece, the arms of the U-shaped member engaging the said side surfaces of the nose and retaining the member against horizontal dislodgement, and the free ends of the arms being flexed upwardly and engaging a rail disposed adjacent the recess and supported on the crosspiece whereby to retain the rail in position, and a metallic reinforcing member disposed between said securing member and said nose bearing and side surfaces and also having a portion engaging an edge portion of the rail.

2. The combination of claim 1, characterized in that the metallic reinforcing member is formed by a U-shaped strip and a surface metal plate connected together, wherein the surface metal plate partially encloses the mouth of the recess, forms the rail engaging surface and has a projection which extends laterally into the concrete, and wherein the shaped strip surrounds the nose and is partially surrounded by concrete.

3. The concrete crosstie according to claim 2 characterized in that the recess is provided with a drain bore.

4. The concrete crosstie according to claim 1 characterized in that the recess is provided with a drain bore.

5. A method of making the recesses in concrete crossties according to claim 1, characterized in that the recesses are formed by corresponding filling bodies which are inserted into a crosstie casting mold and which receive the metallic reinforcing members in form-locking manner in corresponding recesses and after the setting of the concrete crosstie the filling bodies are dissolved out.

* * * * *